US009326546B2

(12) United States Patent
Garcia Urbano et al.

(10) Patent No.: US 9,326,546 B2
(45) Date of Patent: May 3, 2016

(54) FILTER CIGARILLO AND PROCESS OF MANUFACTURING FILTER CIGARILLOS

(75) Inventors: Miguel Angel Garcia Urbano, Madrid (ES); Jorge Alonso Rueda, Madrid (ES); Regine Wolfgramm, Hamburg (DE); Henning Seidel, Hamburg (DE); Fabian Rieth, Hamburg (DE)

(73) Assignee: Imperial Tobacco Ltd., Bristol (GB)

( * ) Notice: Subject to any disclaimer, the term of this patent is extended or adjusted under 35 U.S.C. 154(b) by 697 days.

(21) Appl. No.: 13/814,228

(22) PCT Filed: Jul. 20, 2011

(86) PCT No.: PCT/EP2011/003647

§ 371 (c)(1), (2), (4) Date: Apr. 2, 2013

(87) PCT Pub. No.: WO2012/016641

PCT Pub. Date: Sep. 2, 2012

(65) Prior Publication Data

US 2013/0206152 A1 Aug. 15, 2013

(30) Foreign Application Priority Data

Aug. 2, 2010 (EP) ..... 10171644

(51) Int. Cl.

| | |
|---|---|
| ***A24D 1/00*** | (2006.01) |
| ***A24D 1/04*** | (2006.01) |
| ***A24C 5/47*** | (2006.01) |

(52) U.S. Cl.

CPC ..... *A24D 1/045* (2013.01); *A24C 5/475* (2013.01)

(58) Field of Classification Search

None

See application file for complete search history.

(56) References Cited

U.S. PATENT DOCUMENTS

| | | | | |
|---|---|---|---|---|
| 2,250,381 | A * | 7/1941 | Kayner | A24D 1/045 131/331 |
| 4,243,053 | A * | 1/1981 | Cartwright | A24D 1/10 131/331 |
| 4,582,071 | A * | 4/1986 | Westcott | A24D 3/043 131/336 |
| 2002/0023655 | A1* | 2/2002 | Fietkau | A24C 5/24 131/284 |
| 2010/0154808 | A1* | 6/2010 | Boll | A24D 1/00 131/58 |

FOREIGN PATENT DOCUMENTS

| | | |
|---|---|---|
| CH | 194240 | 11/1937 |
| DE | 1010893 | 6/1957 |
| EP | 02272386 | 12/2011 |
| FR | 1428865 | 2/1966 |
| GB | 2283401 | 5/1995 |

* cited by examiner

*Primary Examiner* — Mchael J Felton

(74) *Attorney, Agent, or Firm* — Hovey Williams LLP

(57) ABSTRACT

A filter cigarillo comprises a bunch, which includes tobacco surrounded by a binder. A first section, different from a general bunch and providing some strengthening effect, is arranged at one end of the bunch. A natural-leaf wrapper surrounds the general bunch and the first section. A second section, which comprises filter material, is arranged downstream of the first section. The second section is connected to the natural-leaf wrapper by an outer tipping.

33 Claims, 2 Drawing Sheets

FILTER CIGARILLO AND PROCESS OF MANUFACTURING FILTER CIGARILLOS

CROSS-REFERENCE TO RELATED APPLICATIONS

Figure 1:
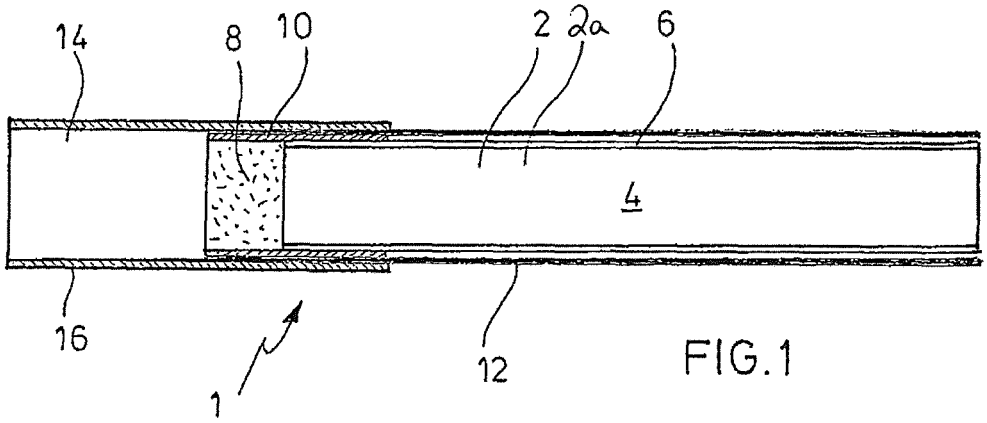

This is a National Phase Application pursuant to 37 C.F.R. §371 of International Application No. PCT/EP2011/003647, filed Jul. 20, 2011, claiming priority from European Application No. 10171644.7, filed Aug. 2, 2010, the entire disclosures of which are hereby incorporated by reference herein.

BACKGROUND OF THE INVENTION

1. Field of the Invention

The invention relates to a filter cigarillo which comprises a natural-leaf wrapper as well as to a process of manufacturing such filter cigarillo.

2. Discussion of the Prior Art

Conventional cigarillos are often surrounded by a wrapper made from reconstituted tobacco. In case of a filter cigarillo, the reconstituted-tobacco wrapper can also encircle the filter. Consumers generally do not have problems with the taste of the reconstituted tobacco they come in touch with in the filter area.

If in a cigarillo of this kind the reconstituted tobacco wrap is replaced by a natural leaf wrapper, many consumers would prefer a less strong taste in the filter area.

To this end, it is conceivable, to provide in the filter end area of the cigarillo a milder material, e.g. a tipping paper. For example, a filter section could be connected to the natural-leaf wrapper forming the outer layer of the cigarillo by means of tipping paper.

The process of attaching or gluing tipping paper to a natural-leaf wrapper, however, can be troublesome. Additionally, the rough surface of the natural-leaf wrapper results in a wrinkled and unpleasant appearance of the tipping paper.

SUMMARY

The object of the invention is to provide a filter cigarillo comprising a natural-leaf wrapper, in which the contact of the user's lips with the natural-leaf wrapper is virtually avoided and which allows for an appealing design.

This object is achieved by a filter cigarillo comprising a bunch, which comprises tobacco and a binder surrounding the tobacco, with a general bunch being defined by at least part of the bunch; a first section arranged at one end of the bunch and different from the general bunch; a natural-leaf wrapper surrounding the general bunch and the first section; and a second section arranged downstream of the first section and comprising filter material, wherein the second section is connected to the natural-leaf wrapper by an outer tipping. A process of manufacturing such filter cigarillos is also disclosed, as are advantageous embodiments of the invention.

As noted above, the filter cigarillo according to the invention comprises a bunch, which includes tobacco and a binder surrounding the tobacco. The binder, a conventional feature of a cigarillo, can be made of any suitable material, e.g. from paper (e.g. porous paper fleece) or reconstituted tobacco. According to the invention, a first section is arranged at one end of the bunch. The first section is different from the general bunch, as outlined by means of advantageous embodiments further below. A wrapper of natural tobacco leaf (natural-leaf wrapper) surrounds the general bunch and the first section (which includes the case that the natural-leaf wrapper is only partially present in the area of the first section). A second section is arranged downstream of the first section, i.e. further remote from the general bunch than the first section. The second section comprises filter material and is connected to the natural-leaf wrapper by an outer tipping. Generally, the outer tipping is made from sheet material, e.g. from paper (tipping paper) or reconstituted tobacco.

The appearance of the surface of the filter cigarillo according to the invention is determined by the natural-leaf wrapper and by the outer tipping. Upon smoking the cigarillo, the user's lips contact the outer tipping only, thus avoiding any strong taste of the natural-leaf wrapper. The first section reinforces the end of the bunch. This facilitates the handling and processing steps of the filter cigarillo. In particular, the first section is able to exert counter-forces when the outer tipping is attached, e.g. by means of a glue, such that the cigarillo keeps its shape. Moreover, due to the presence of the first section, the outer tipping stays largely smooth. Thus, the filter cigarillo according to the invention is user-friendly, has an appealing appearance and aids in facilitating the manufacturing process.

In advantageous embodiments of the invention, the first section is designed as a part independent of the bunch. In this case, the first section can be connected to the bunch by an inner tipping, which is arranged underneath the natural-leaf wrapper and which also may provide for an additional support for the outer tipping. The inner tipping comprises sheet-like material, e.g. paper, porous paper, stiff wrapper material, carton, fleece, reconstituted tobacco, printed paper, flavoured paper, flavoured fleece, or flavoured reconstituted tobacco. The length of the outer tipping may correspond to the length of the inner tipping plus the length of the second section.

The first section can comprise filter material. In this case, the presence of two filter sections (i.e. the first section and the second section) provides additional advantages. Generally, it increases the possibilities of filter versatility and for adjustment options to certain designs. The filter material for the first section and for the second section can be individually selected. Examples for the filter material of the first section are cellulose acetate, cellulose, regenerated cellulose, lyocell, paper, tobacco, reconstituted tobacco, polypropylene and/or polyethylene. It is also conceivable that the first section as such or the second section as such is designed as a "multi-filter", i.e. a filter having two (or even more than two) axially arranged filter sections.

The first section may also comprise other materials, like adsorbents (e..g. active carbon or silica), humidifying agents (e.g. glycerol or injected humidifying agents), flavourants (e.g. as encapsulated flavourants, thread-incorporated flavourants or injected flavourants), acidifying agents (e.g. citric acid or malic acid), or plasticisers. Combinations of such materials are conceivable as well, also in combination with filter material. An example is activated charcoal dispersed in a matrix of cellulose acetate.

Alternatively, the first section may be designed as a hollow tube or as a flow restriction device in general (without being filled with filter material). Examples for such flow restrictions devices are a plurality of hollow tubelets (e.g. an assembly of small tubes arranged in parallel, preferably in a hollow tube having the diameter of the bunch) or an insert of fixed-propeller design (e.g. an assembly in which the space between two concentric tubes of different diameter, the outer one having the diameter of the bunch, contains some kind of twisted propeller-shaped wings). Another possibility is an insert of open-pore sponge design. All these devices can provide an outer surface which well reinforces the end of the bunch and is suited as a backing for the natural-leaf wrapper and the outer tipping. Moreover, the flow characteristics of the cigarillo can be influenced in a positive manner.

In other advantageous embodiments of the invention, the first section includes an integral portion of the bunch and comprises a generally higher tobacco density than the bunch. A higher tobacco density means a greater hardness in the area of the end of the bunch, i.e. the desired strengthening effect. In this case, optionally the first section can be surrounded by sheet material in addition to the binder, which even increases the strengthening effect. During the production of the bunches, a locally higher tobacco density can be achieved by feeding relatively more tobacco to the area in question. Generally, this kind of providing the first section of the filter cigarillo is relatively inexpensive and easy to produce.

It is also conceivable that, in the first section of other advantageous embodiments of the filter cigarillo according to the invention, the bunch is surrounded by at least one layer of stiffening material. That means, the bunch can be a conventional bunch wherein the first section is defined by the section surrounded by the at least one layer of stiffening material. The stiffening material can be a material as used for a tipping, e.g. tipping paper or reconstituted tobacco. When more than one layer is applied, the layers may be separate layers, or the stiffening material may be spirally wound. The stiffening material provides for the desired strengthening effect. Again, this design of the first section of the filter cigarillo is relatively inexpensive.

The filter material of the second section can comprise, e.g. cellulose acetate, cellulose, regenerated cellulose, lyocell, paper, tobacco, reconstituted tobacco, polypropylene, polyethylene, or mixtures thereof. Moreover, the second section may include additional materials like adsorbents (e.g. active carbon, silica), humidifying agents (e.g. glycerol, encapsulated humidifying agents, injected humidifying agents), flavourants (e.g. encapsulated flavourants, thread-incorporated flavourants, injected flavourants), acidifying agents (e.g. citric acid, malic acid) and/or plasticisers. That means, the second section can be designed as a filter in any appropriate way.

A large variety of materials can, be used for the outer tipping, in particular paper, porous paper, fleece, reconstituted tobacco, flavoured paper, flavoured fleece or flavoured reconstituted tobacco. The outer tipping may also comprise a particular design. For example, it may be coloured, partially coloured, provided with a relief structure, provided with an imprint, provided with a water mark, provided with a punching, provided with an embossing and/or provided with flavourant.

As an additional feature influencing the general appearance of the filter cigarillo, the visible end side of the second section may be designed in a particular way, e.g. coloured, partially coloured, provided with a relief, provided with an imprint, provided with a punching and/or provided with an embossing.

In order to adjust the ventilation properties of the filter cigarillo, perforations can be provided. For example, the area of the outer tipping can comprise perforations. In an advantageous embodiment, at least part of the perforations is longitudinally arranged (i.e. in parallel to the longitudinal axis of the cigarillo), preferably by mechanical perforation. The perforations can be made in any suitable way, in particular as laser perforations (online or offline), by electrical means (online or offline) or by mechanical means (online or offline). If the filter cigarillo is perforated in the filter area, it is preferably radially perforated by means of laser (online), i.e. the perforations are generally arranged along circumferentially extending circular lines or parts thereof. "Online" means during the production of the filter cigarillo, "offline" means by using material containing pre-fabricated perforations.

Generally, the filter cigarillo can have a diameter in the range of 5 mm to 14 mm.

The filter cigarillos according to the invention can be manufactured by applying modifications to a process in which an intermediate double article enveloped with a natural-leaf wrapper is formed.

To this end, when the first section is designed as a part independent of the bunch, two axially aligned bunches having a first axial space with respect to each other are provided. These bunches comprise tobacco surrounded by a binder and can be produced in a conventional way, e.g. on a continuous-rod making machine. A first segment is inserted into the first axial space, wherein the first segment consists of two first sections of a filter cigarillo. Now, preferably, the first segment is connected to each of the bunches by an inner tipping wrap. Afterwards, the two bunches and the first segment are enveloped with a natural-leaf wrapper to produce an intermediate double article by using a process as the process mentioned above. The intermediate double article is separated into two intermediate articles, which are axially spaced in order to provide a second axial space. Into this second axial space, a second segment is inserted, which is constituted of two second sections of a filter cigarillo. The second segment is connected to each of the intermediate articles by an outer tipping wrap to provide a double filter cigarillo. Finally, the double filter cigarillo is cut to provide two filter cigarillos.

When the first section is an integral portion of the bunch and comprises a generally higher tobacco density than the general bunch, the process can be run in the following way: At first, a double bunch comprising two axially aligned bunches is provided, wherein the first sections, comprising a generally higher tobacco density than the rest of the double bunch, and optionally being surrounded by sheet material in addition to the binder, are located in the centre area of the double bunch. The double bunch is enveloped with a natural-leaf wrapper to produce an intermediate double article. The intermediate double article is separated into two intermediate articles, which are axially spaced to provide an axial space, A segment consisting of two second sections of a filter cigarillo is inserted into this axial space. The segment is connected to each of the intermediate articles by an outer tipping wrap to provide a double filter cigarillo. Finally, the double filter cigarillo is separated to provide two filter cigarillos.

A process of manufacturing filter cigarillos wherein in the first section is surrounded by at least one layer of stiffening material can be run similar to the process described before. It starts with providing a double bunch comprising two axially aligned bunches, wherein the first sections are located in the centre area of the double bunch. In a pre-step, at least one layer of stiffening material has been wrapped and optionally glued about the centre area of the double bunch in order to prepare the first sections. The double bunch is enveloped with a natural-leaf wrapper to produce an intermediate double article. (Alternatively, the stiffening material can be wound around the natural-leaf wrapper in the area of the two first sections of the intermediate double article; in this way the stiffening material provides a support layer.) The intermediate double article is separated into two intermediate articles, which are axially spaced. A segment is inserted into the axial space, wherein the segment consists of two second sections of a filter cigarillo. The segment is connected to each of the inter mediate articles by an outer tipping wrap to provide a double filter cigarillo. The double filter cigarillo is separated to provide two filter cigarillos.

To achieve clean end faces of the filter cigarillos, in each filter cigarillo, the end remote from the second section can be trimmed. This step can be performed, e.g., after the natural-leaf wrapper has been applied and when the intermediate double article is cut or separated, or independent thereof, e.g., at the end of the process when the double filter cigarillo is separated.

BRIEF DESCRIPTION OF THE DRAWING FIGURES

Figure 2:
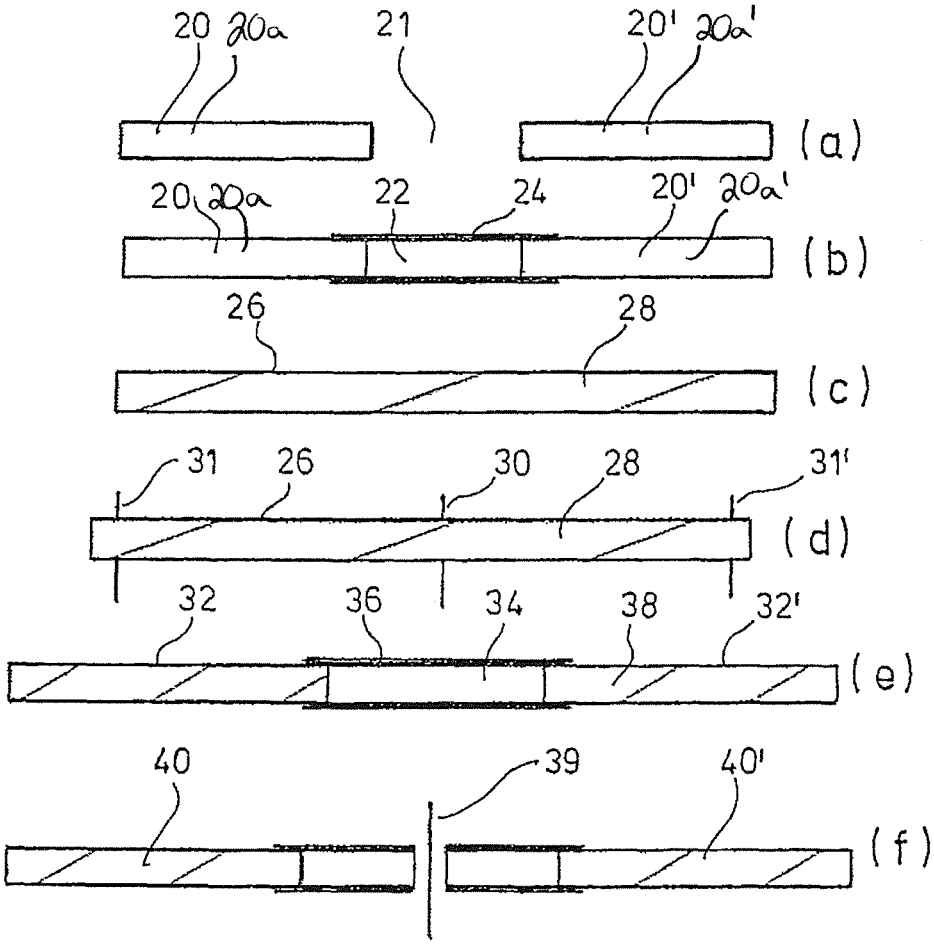
Figure 3:
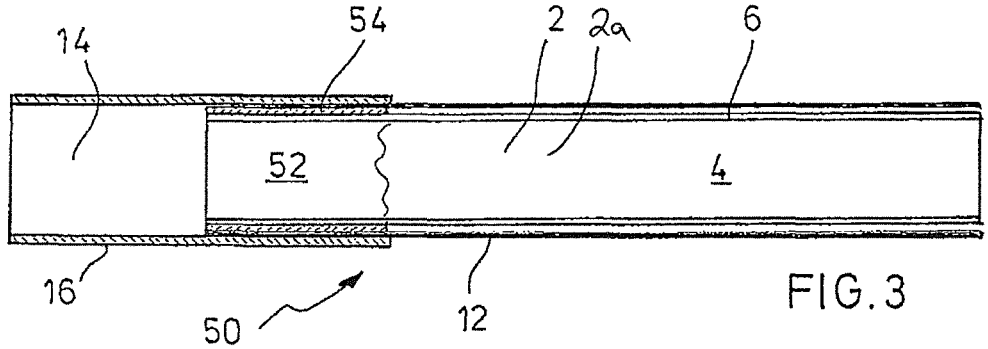
Figure 4:
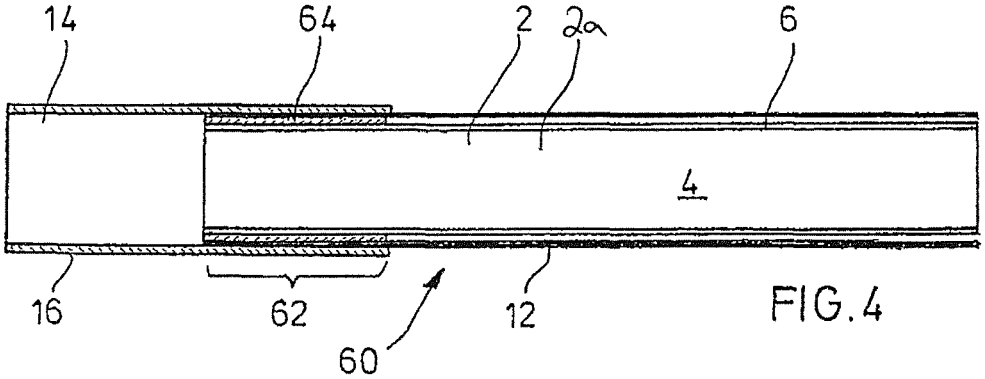
Figure 5:
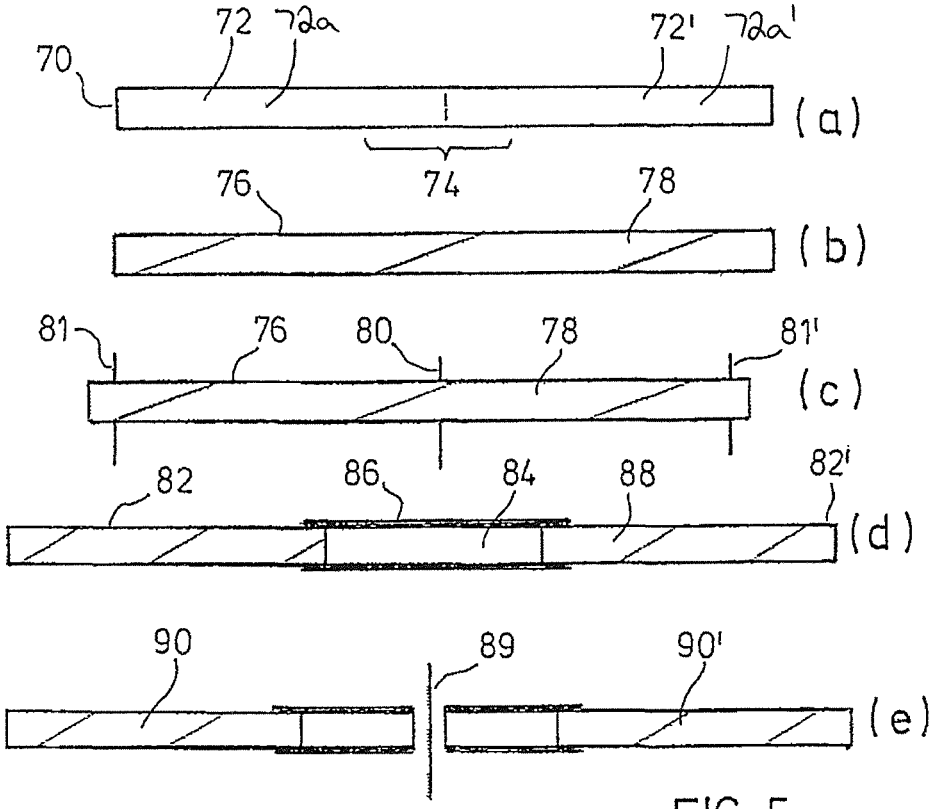

In the following, the invention is further described by means of embodiments. The drawings show in:

FIG. 1 a schematic longitudinal section of an embodiment of the filter cigarillo according to the invention, FIG. 2 schematic representations of consecutive steps in an embodiment of a process of manufacturing filter cigarillos according to FIG. 1, FIG. 3 a schematic longitudinal section of another embodiment of the filter cigarillo according to the invention, FIG. 4 a schematic longitudinal section of still another embodiment of the filter cigarillo according to the invention, and FIG. 5 schematic representations of consecutive steps in an embodiment of a process of manufacturing filter cigarillos according to FIG. 3 and according to FIG. 4, respectively.

DETAILED DESCRIPTION OF THE PREFERRED EMBODIMENTS

In FIG. 1, a filter cigarillo 1 is represented in a schematic longitudinal section, which is not drawn to scale.

The filter cigarillo 1 includes a bunch 2, which comprises tobacco 4 and a binder 6 surrounding the tobacco. In the embodiment, the bunch 2 has been manufactured by an endless-rod process, in which a tobacco rod is wrapped with a binder material made of reconstituted tobacco, the longitudinal seal of the binder generated during the wrapping process is glued, and the endless rod produced in this way is cut into individual bunches like the bunch 2.

A first section 8 is arranged at one end of the bunch 2. In the embodiment, the first section 8 comprises filter material, i.e. cellulose acetate. The first section 8 is connected to the bunch 2 by means of an inner tipping paper 10 glued to the lateral surfaces of the first section 8 and the end area of the binder 6.

The bunch 2 includes a general bunch 2*a* that includes any part of the bunch 2 that is not part of the first section 8. In the embodiment illustrated in FIG. 1, for instance, the general bunch 2*a* includes the entirety of the bunch 2.

The composite of bunch 2, first section 8 and inner tipping paper 10 is surrounded by a wrapper 12 made of natural tobacco leaf (natural-leaf wrapper). In the embodiment, the natural-leaf wrapper 12 is wrapped in a helical manner and fixed to the binder 6, e.g. by glue spots at the end regions.

A second section 14, in the embodiment designed as a filter section containing cellulose acetate, is arranged at the end of the first section 8 being remote from the tobacco 4, i.e. downstream of the first section 8. The second section 14 is connected to the natural-leaf wrapper 12 by means of an outer tipping paper 16. In the embodiment, the outer tipping paper 16 comprises, in the area of the second section 14, perforations. The outer tipping paper 16 is glued to the lateral surfaces of the second section 14 and the natural-leaf wrapper 12 lying over the inner tipping paper 10. The length of the outer tipping paper 16 matches the length of the second section 14 plus that of the inner tipping paper 10.

As already outlined in the introductory part of the description, the embodiments of the filter cigarillo 1 can be varied in numerous ways.

FIG. 2 illustrates an embodiment of a process of manufacturing filter cigarillos of the type shown in FIG. 1.

In the step according to FIG. 2(*a*), two axially aligned bunches 20, 20', including respective general bunches 20*a*, 20*a'*, are arranged with a first axial space 21. The bunches 20, 20' can be produced as outlined above.

In the step according to FIG. 2(*b*), a first segment 22 is introduced into the first axial space 21. The first segment 22 consists of two longitudinally aligned first sections like the first section 8. The first segment 22 is connected to the adjacent end regions of the bunches 20, 20' by means of an inner tipping paper wrap 24, as also shown in FIG. 2(*b*).

In the step according to FIG. 2(*c*), the bunches 20, 20' and the first segment 22 including the inner tipping paper wrap 24 are enveloped with a natural-leaf wrapper 26. In the embodiment, the natural-leaf wrapper 26 is wound in a helical manner, as indicated by the diagonal lines in FIG. 2. To this end, a rolling process can be applied as that disclosed in European Patent Application 09305656.2. It is also conceivable to roll the natural-leaf wrapper in axial manner, resulting in a longitudinal seam. In this way, an intermediate double article 28 is formed.

In the step according to FIG. 2(*d*), the intermediate double article 28 is severed by a cut 30. At the same time, the free ends of the former intermediate double article 28 are trimmed by cuts 31 and 31' in order to provide clean end faces with a proper appearance of the natural-leaf wrapper 26. In this way, two intermediate articles 32, 32' are formed. The trim cuts 31 and 31' could also be performed later in the process, e.g. at the end of the steps according to FIG. 2(*e*) or during the step according to FIG. 2(*f*).

In the following steps ending with FIG. 2(*e*), the intermediate articles 32 and 32' are moved away from each other, keeping them axially aligned, in order to provide a second axial space, into which a second segment 34 is inserted and is connected by means of an outer tipping paper wrap 36. The second segment 34 consists of two longitudinally aligned second sections 14 (FIG. 1).

Finally, the double filter cigarillo 38 formed in this way is severed by a central cut 39 such that two filter cigarillos 40, 40' like filter cigarillo 1 (FIG. 1) are generated, see FIG. 2(*f*).

FIG. 3 illustrates a filter cigarillo 50 which differs from filter cigarillo 1 according to FIG. 1 in the design of the first section. Because the other features are similar and need not be explained again, the same reference numerals are used as in FIG. 1, with the exceptions that reference numeral 8 is replaced by 52 and reference numeral 10 by 54.

In filter cigarillo 50, the first section is formed as a zone 52 in which the density of the tobacco 4 is generally greater than in the general bunch 2*a*. This increases the hardness of the filter cigarillo 50 in the area of the zone 52. Moreover, in the area of zone 52 or even in an area extending beyond zone 52, the binder 6 is surrounded by one or by more than one layer of sheet material 54, e.g. tipping paper, which increases the strengthening effect. In a variant, the filter cigarillo does not comprise the sheet material 54.

FIG. 4 shows another filter cigarillo, designated by 60, which differs from filter cigarillo 1 in the design of. the first section. Again, because the other features are similar and need not be explained again, the same reference numerals are used as in FIG. 1, with the exceptions that reference numeral 8 is replaced by 62 and reference numeral 10 by 64.

In filter cigarillo 60, the first section 62 is defined by one or more than one layer of stiffening material 64 surrounding one end area of the bunch 2. The density of the tobacco 4 in the bunch 2 is largely constant. Thus, the desired strengthening effect is achieved by means of the stiffening material 64 alone, which in the embodiment is made of tipping paper. Other materials providing a sufficient strengthening effect are conceivable as well. The stiffening material 64 can be fixed by means of glue.

FIG. 5 schematically illustrates a process of manufacturing filter cigarillos like filter cigarillo 50 or filter cigarillo 60.

In the step according to FIG. 5(*a*), a double bunch 70 comprising two axially aligned bunches 72, 72', including respective general bunches 72*a*, 72*a'*, is provided, wherein the first sections are located in the centre area 74 of the double bunch 70. In the case of filter cigarillos 50, the first sections are integral portions of the bunches 72, 72' and comprise a generally higher tobacco density than the general bunches 72*a*, 72*a'*. During the production of appropriate double bunches 70, a locally higher tobacco density can be achieved by feeding relatively more tobacco to the area 74. In the case of filter cigarillos 60, in a pre-step at least one layer of stiffening material has been wrapped and optionally glued about the centre area of the double bunch 70 in order to prepare the first sections. This stiffening material is not shown in FIG. 5. The same holds for any optional sheet material applied to the centre area of the double bunch 70 in the case of filter cigarillos 50 (see reference numeral 54 in FIG. 3).

In the step according to FIG. 5(*b*), the double bunch 70 is enveloped with a natural-leaf wrapper 76 to produce an intermediate double article 78. In the embodiment, the natural-leaf wrapper 76 is wound in a helical manner, as indicated by the diagonal lines in FIG. 5. To this end, a rolling process can be applied as that disclosed in European Patent Application 09305656.2. It is also conceivable to roll the natural-leaf wrapper in axial manner, resulting in a longitudinal seam.

In the step according to FIG. 5(*c*), the intermediate double article 78 is severed by a cut 80. At the same time, the free ends of the former intermediate double article 78 can be trimmed by cuts 81 and 81' in order to provide clean end faces with a proper appearance of the natural-leaf wrapper 76. In this way, two intermediate articles 82, 82' are formed. The trim cuts 81 and 81' could also be performed later in the process, e.g. at the end of the steps according to FIG. 5(*d*) or during the step according to FIG. 5(*e*).

In the following steps ending with FIG. 5(*d*), the intermediate articles 82 and 82' are moved away from each other, keeping them axially aligned, in order to provide an axial space, into which a segment 84 is inserted and is connected by means of an outer tipping wrap 86. The segment 84 consists of two second sections 14.

Finally, the double filter cigarillo 88 formed in this way is severed by a central cut 89 such that two filter cigarillos 90, 90' like filter cigarillo 50 (FIG. 3) or filter cigarillo 60 (FIG. 4) are generated, see FIG. 5(*e*).

The invention claimed is:

1. Filter cigarillo comprising:

a bunch, which comprises tobacco and a binder surrounding the tobacco, with a general bunch being defined by at least part of the bunch;

a first section arranged at one end of the bunch and different from the general bunch;

a natural-leaf wrapper surrounding the general bunch and the first section; and a second section arranged downstream of the first section and comprising filter material, wherein the second section is connected to the natural-leaf wrapper by an outer tipping.

2. Filter cigarillo according to claim 1, wherein the first section is designed as a part independent of the bunch.

3. Filter cigarillo according to claim 2, wherein the first section is connected to the bunch by an inner tipping, which is arranged underneath the natural-leaf wrapper.

4. Filter cigarillo according to claim 3, wherein the inner tipping comprises one of the following materials: paper, porous paper, stiff wrapper material, carton, fleece, reconstituted tobacco, printed paper, flavoured paper, flavoured fleece, flavoured reconstituted tobacco.

5. Filter cigarillo according to claim 3, wherein each of said outer tipping, said inner tipping, and said second section presents a respective length, wherein the length of the outer tipping corresponds to the length of the inner tipping plus the length of the second section.

6. Filter cigarillo according to claim 2, wherein the first section comprises filter material.

7. Filter cigarillo according to claim 6, wherein the filter material of the first section comprises at least one of the materials of the following list: cellulose acetate, cellulose, regenerated cellulose, lyocell, paper, tobacco, reconstituted tobacco, polypropylene, polyethylene.

8. Filter cigarillo according to claim 2, wherein the first section comprises at least one of the materials of the following list: adsorbents, active carbon, silica; humidifying agents, glycerol, injected humidifying agents; flavourants, encapsulated flavourants, thread-incorporated flavourants, injected flavourants; acidifying agents, citric acid, malic acid; plasticisers.

9. Filter cigarillo according to claim 2, wherein the first section comprises one of the following devices: hollow tube, flow restriction device, plurality of hollow tubelets, insert of fixed-propeller design, insert of open-pore sponge design.

10. Filter cigarillo according to claim 1, wherein the first section includes an integral portion of the bunch and comprises a generally higher tobacco density than the general bunch.

11. Filter cigarillo according to claim 1, wherein the first section is surrounded by at least one layer of stiffening material.

12. Filter cigarillo according to, claim 1, wherein the filter material of the second section comprises at least one of the materials of the following list:

cellulose acetate, cellulose, regenerated cellulose, lyocell, paper, tobacco, reconstituted tobacco, polypropylene, polyethylene.

13. Filter cigarillo according to claim 1, wherein the second section comprises at least one of the materials of the following list: adsorbents, active carbon, silica; humidifying agents, glycerol, encapsulated humidifying agents, injected humidifying agents; flavourants, encapsulated flavourants, thread-incorporated flavourants, injected flavourants; acidifying agents, citric acid, malic acid; plasticisers.

14. Filter cigarillo according to claim 1, wherein the outer tipping comprises one of the following materials: paper, porous paper, fleece, reconstituted tobacco, flavoured paper, flavoured fleece, flavoured reconstituted tobacco.

15. Filter cigarillo according to claim 1, wherein the outer tipping comprises at least one of the designs of the following list: coloured, partially coloured, provided with relief, provided with imprint, provided with water mark, provided with punching, provided with embossing, provided with flavourant.

16. Filter cigarillo according to claim 1, wherein the second section comprises a free end side comprising at least one of the designs of the following list: coloured, partially coloured, provided with relief, provided with imprint, provided with punching, provided with embossing.

17. Filter cigarillo according to claim 1, wherein the filter cigarillo comprises perforations.

18. Filter cigarillo according to claim 17, wherein the outer tipping is provided with perforations.

19. Filter cigarillo according to claim 17, wherein at least part of the perforations is longitudinally arranged.

20. Filter cigarillo according to claim 17, wherein the perforations are of one of the following types: online-made laser perforations, offline-made laser perforations, online-made electrically-provided perforations, offline-made electrically-provided perforations, online-made mechanical perforations, offline-made mechanical perforations.

21. Filter cigarillo according to claim 1, wherein said filter cigarette has a diameter in one of the following ranges: 5 mm to 6 mm, 6 mm to 7 mm, 7 mm to 8 mm, 8 mm to 9 mm, 9 mm to 10 mm, 10 mm to 12 mm, 12 mm to 14 mm.

22. Filter cigarillo according to claim 1, wherein the binder is made from paper.

23. Process of manufacturing filter cigarillos having the features of a filter cigarillo according to claim 2, including the following steps:

a) providing two axially aligned bunches having a first axial space with respect to each other;

b) inserting a first segment into the first axial space, wherein the first segment comprises two first sections of a filter cigarillo;

c) enveloping the two bunches and the first segment with the natural-leaf wrapper to produce an intermediate double article;

d) separating the intermediate double article into two intermediate articles and axially spacing the intermediate articles to provide a second axial space;

e) inserting a second segment into the second axial space, wherein the second segment comprises two second sections of a filter cigarillo;

f) connecting the second segment to each of the intermediate articles by an outer tipping wrap to provide a double filter cigarillo; and g) separating the double filter cigarillo to provide two filter cigarillos.

24. Process according to claim 23, wherein, prior to step c), the first segment is connected to each of the bunches by an inner tipping wrap.

25. Process of manufacturing filter cigarillos having the features of a filter cigarillo according to claim 10, including the following steps:

a) providing a double bunch comprising two axially aligned bunches and two first sections, wherein the first sections, are located in a centre area of the double bunch, b) enveloping the double bunch with the natural-leaf wrapper to produce an intermediate double article;

c) separating the intermediate double article into two intermediate articles and axially spacing the intermediate articles to provide an axial space;

d) inserting a segment into the axial space, wherein the segment comprises two second sections of a filter cigarillo;

e) connecting the segment to each of the intermediate articles by an outer tipping wrap to provide a double filter, cigarillo; and f) separating the double filter cigarillo to provide two filter cigarillos.

26. Process of manufacturing filter cigarillos having the features of a filter cigarillo according to claim 11, including the following steps:

a) providing a double bunch comprising two axially aligned bunches and two first sections, wherein the first sections are surrounded by at least one layer of stiffening material and are located in a centre area of the double bunch, b) enveloping the double bunch with the natural-leaf wrapper to produce an intermediate double article;

c) separating the intermediate double article into two intermediate articles and axially spacing the intermediate articles to provide an axial space;

d) inserting a segment into the axial space, wherein the segment comprises two second sections of a filter cigarillo;

e) connecting the segment to each of the intermediate articles by an outer tipping wrap to provide a double filter, cigarillo; and f) separating the double filter cigarillo to provide two filter cigarillos.

27. Process according to claim 23, further including the step of, in each filter cigarillo, trimming an end remote from the second section.

28. Filter cigarillo according to claim 10, wherein the first section is surrounded by sheet material in addition to the binder.

29. Filter cigarillo according to claim 11, wherein the first section includes an integral portion of the bunch.

30. Filter cigarillo according to claim 22, wherein the binder is made from a porous paper fleece.

31. Process according to claim 25, further including the step of, in each filter cigarillo, trimming an end remote from the second section.

32. Process according to claim 25, wherein the first sections are surrounded by sheet material in addition to the binder.

33. Process according to claim 26, further including the step of, in each filter cigarillo, trimming an end remote from the second section.

* * * * *